United States Patent [19]

Buder

[11] 4,402,207

[45] Sep. 6, 1983

[54] ZERO CLEARANCE DEVICE FOR ROLLING MILL APPARATUS

[75] Inventor: Thomas E. Buder, Godfrey, Ill.

[73] Assignee: Olin Corporation, New Haven, Conn.

[21] Appl. No.: 281,801

[22] Filed: Jul. 9, 1981

[51] Int. Cl.[3] ..... B21B 31/02

[52] U.S. Cl. ..... 72/241; 72/245; 72/465

[58] Field of Search ..... 72/237, 241, 243, 244, 72/245, 246, 247, 465; 384/260

[56] References Cited

U.S. PATENT DOCUMENTS

| | | | |
|---|---|---|---|
| 1,870,509 | 8/1932 | Heiden | 72/243 |
| 1,964,504 | 6/1934 | Coryell | 72/243 |
| 2,690,002 | 9/1954 | Grenell | 29/157.3 V |
| 3,302,435 | 2/1967 | Lyle et al. | 72/245 |
| 3,495,430 | 2/1970 | Diolot | 72/237 |
| 3,580,034 | 5/1971 | Wilson | 72/237 |
| 3,733,875 | 5/1973 | Steimer | 72/237 |
| 4,041,752 | 8/1977 | Dolenc et al. | 72/201 |
| 4,218,905 | 8/1980 | Lehmann et al. | 72/21 |
| 4,248,074 | 2/1981 | Fuhrmann et al. | 72/247 |
| 4,312,209 | 1/1982 | Hansen | 72/237 |

FOREIGN PATENT DOCUMENTS

| | | | |
|---|---|---|---|
| 54-2246 | 1/1979 | Japan | 72/241 |

*Primary Examiner*—Lowell A. Larson
*Assistant Examiner*—Jonathan L. Scherer
*Attorney, Agent, or Firm*—Barry L. Kelmachter; Howard M. Cohn; Paul Weinstein

[57] ABSTRACT

A rolling mill apparatus for reducing the thickness of a continuous strip material comprises at least two rolls between which the strip passes and inflatable pads for substantially maintaining the vertical and lateral alignment of the rolls and for substantially preventing roll shifting and/or cross-over. The inflatable pads are disposed between roll support assemblies and their respective support structures to substantially eliminate clearances that may develop between them. The inflatable pads preferably comprise a composite metal or metal alloy panel having inflatable fluid passageways.

9 Claims, 5 Drawing Figures

ZERO CLEARANCE DEVICE FOR ROLLING MILL APPARATUS

The invention described herein relates to a rolling mill apparatus for reducing the thickness of a continuous strip material. The instant invention is applicable to a wide range of rolling mills including two-high, three-high, four-high, and six-high, reversing and non-reversing rolling mills.

The use of two-high, three-high, four-high, and six-high rolling mills are well known in the art. Initially, the rolls of these mills have a desired vertical and lateral alignment. Forces, such as frictional forces, vibrational forces, etc., which act on the rolls and roll support assemblies during the rolling process, frequently cause movement of the rolls out of their initial alignment. When these forces cause the rolls to move in a direction substantially parallel to the rolling direction, a condition known as roll shifting occurs. When the forces cause a roll to move so that its axis of rotation becomes angled relative to another roll axis of rotation, a condition known as roll cross-over may occur. This roll shifting and/or roll cross-over can have deleterious effects on the quality of the strip. The strip may have surface defects, shape defects, and/or non-uniform gage as a result of roll shifting and/or roll cross-over. Furthermore, damage to structural components of the mill, i.e. roll support bearings, rolls, etc., may occur.

Various approaches for maintaining roll alignment have been used in the prior art. A first approach utilizes wear or pressure plates mounted to one or more sides of the rolling mill housings. These plates are typically mounted between a roll supporting assembly and the housing. The plates may be either fixedly or adjustably mounted to the housing. The adjustably mounted plates can be provided with either manual adjustment devices such as screws or bolts or self-adjusting devices such as those having springs associated therewith. This first approach is exemplified by U.S. Pat. Nos. 1,870,509 to Heiden, 1,964,504 to Coryell, 3,580,034 to Wilson, and 3,733,875 to Steimer.

This first approach has not always been satisfactory since it is difficult to provide a fine adjustment and difficult to maintain constant pressure or support on the rolls due to plate wear. As the plate wears and the forces associated with rolling act on the rolls and their support assemblies, a clearance, which is sufficient to permit some roll shifting and/or roll cross-over, may develop between the plate support structure and the roll support assemblies. This clearance is generally obviated either by repositioning the plates or by replacing them during shut-down of the rolling mill.

Another prior art approach utilizes hydrostatic pressure devices to provide roll support. The hydrostatic pressure devices exert a hydraulic pressure on an exterior surface of the rolls. The hydraulic pressure is intended to counteract those forces which cause roll shifting and/or roll cross-over. Typical of this type of approach are U.S. Pat. Nos. 4,041,752 to Dolenc et al. and 4,218,905 to Lehmann et al.

Yet another approach utilizes keeper plates on opposite sides of a roll supporting mechanism to prevent axial movement within the windows of the housings. U.S. Pat. No. 4,248,074 to Fuhrmann et al. exemplifies this approach.

While not being specifically directed to preventing roll shifting and/or roll cross-over, it is known in the prior art to use a piston and cylinder type of jack arrangement to obtain variations in the direction and intensity of the forces exerted on the roll support assemblies. The jacks may be arranged at a suitable angle or angles relative to the strip rolling direction to provide the desired forces. U.S. Pat. No. 3,495,430 to Diolot exemplifies this approach.

The present invention comprises a process and apparatus for substantially maintaining the rolls in both vertical and lateral alignment. The instant invention provides reduction of any clearances that may develop between the roll support assemblies and their respective support structures to substantially zero and thereby substantially prevent roll shifting and/or roll cross-over.

In accordance with the instant invention, an inflatable pad or panel is inserted between each roll supporting assembly and a sidewall of a respective support structure. The support structure may be a housing window, a notch in which the roll supporting assembly nests, etc. The inflatable pads substantially maintain the rolls in vertical and lateral alignment and thereby substantially prevent roll shifting and/or roll cross-over by acting against one side of each roll support assembly. In a preferred embodiment, each inflatable pad comprises a composite metal or metal alloy panel having inflatable passageways. The inflatable pads are connected to a source of pressurized fluid.

All of the inflatable pads or panels are preferably mounted on one side of the rolling mill so that the tolerances necessary to hold the rolls in proper position may be made to accumulate from only one side. If the tolerances were permitted to accumulate from both sides, roll cross-over could occur. In a non-reversing rolling mill, the inflatable pads or panels are preferably mounted on the strip entry side of the mill so that the forces pulling on the strip do not act against the inflatable pads or panels.

The inflatable pads or panels of the instant invention do not hinder upward or downward movement of the roll assemblies and replacement of the rolls. By maintaining the pads or panels in a deflated or partially inflated condition, sufficient clearance to allow upward and downward movement of the roll support assemblies for gage control and to allow removal of a roll and insertion of a new roll can be provided.

Accordingly, it is an object of this invention to provide a rolling mill with a process and apparatus for substantially maintaining the rolls in vertical and lateral alignment.

It is a further object of this invention to provide a process and apparatus as above for substantially preventing roll shifting and/or roll cross-over by substantially reducing any clearances between the roll support assemblies and their support structures to approximately zero.

These and other objects will become more apparent from the following description and drawings.

Embodiments of the rolling mill apparatus according to this invention are shown in the drawings wherein like numerals depict like parts.

Figure 1:
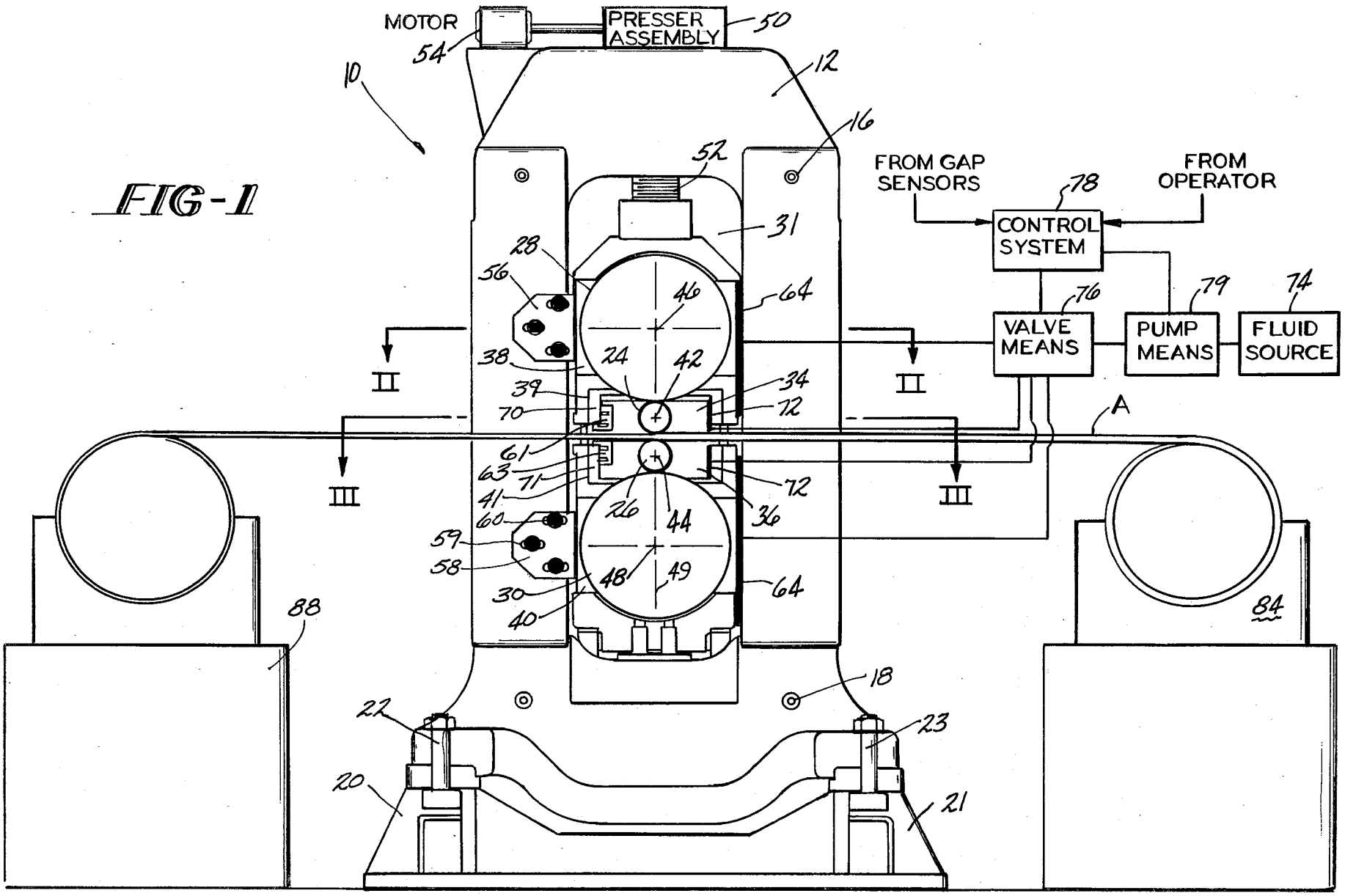
FIG. 1 is a schematic representation in partial cross section of a rolling mill apparatus.
Figure 4:
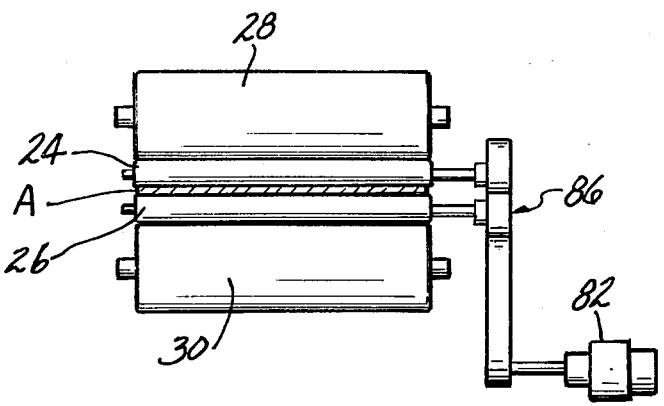
FIG. 4 is a schematic representation of the motor and drive assemblies of the rolling mill apparatus.
Figure 2:
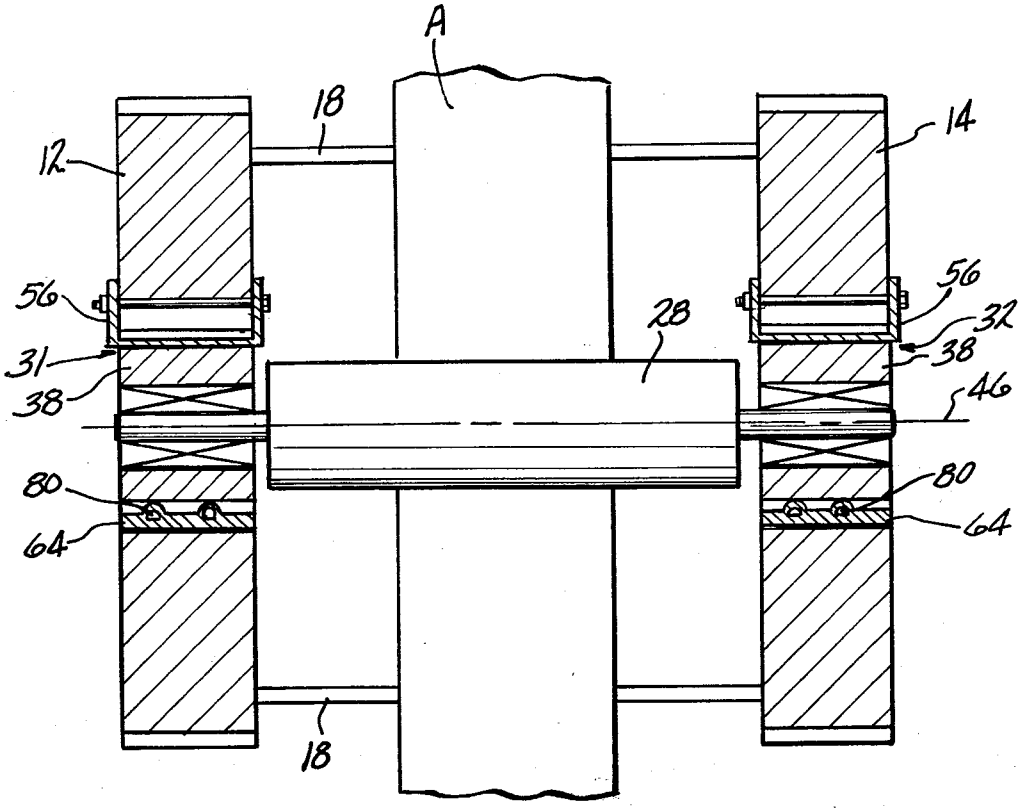
FIG. 2 is a sectional view along line II—II of FIG. 1.

A process and apparatus for substantially maintaining a desired vertical and lateral alignment of the rolls of a rolling mill is described herewith. The apparatus comprises at least one inflatable pad for substantially preventing roll shifting and/or roll cross-over. The instant invention is readily adaptable to many types of rolling mills including two-high, three-high, four-high, and six-high rolling mills.

As used herein, the term vertical alignment means the desired alignment of the axes of rotation of the rolls substantially in a plane oriented at an angle, preferably up to about 90°, relative to the strip rolling direction. As used herein, the term lateral alignment means that the axis of rotation of each roll has a desired orientation substantially transverse to the strip rolling direction.

Referring now to FIGS. 1-4, a four-high rolling mill apparatus 10 for reducing the thickness of a continuous strip material is shown. Rolling mill apparatus 10 has a pair of laterally spaced apart housings 12 and 14 which are separated from one another by a plurality of separators 16 and 18. While two pairs of separators have been shown, any suitable number of separators may be employed. Each of the housings 12 and 14 is mounted upon a pair of shoes 20 and 21. The housings 12 and 14 are secured to shoes 20 and 21 by bolt and nut assemblies 22 and 23 or by any other suitable fastening arrangement.

The four-high rolling mill apparatus 10 has upper and lower work rolls 24 and 26 and upper and lower back-up rolls 28 and 30. The strip of material A to be reduced in thickness passes between the work rolls 24 and 26. The work rolls 24 and 26 are preferably driven by a motor assembly 82 through any suitable conventional drive arrangement 86. U.S. Pat. No. 1,964,504 to Coryell, which is hereby incorporated by reference, describes such a suitable motor assembly and drive arrangement. In lieu of driving the work rolls 24 and 26, the motor assembly 82 could drive the back-up rolls 28 and 30 through any suitable drive arrangement not shown. When utilizing this type of drive system, rotational or drive forces are imparted to work rolls 24 and 26 through the frictional forces that develop between the work rolls 24 and 26 and their associated back-up rolls 28 and 30. Alternatively, each of the work rolls 24 and 26 and each of the back-up rolls 28 and 30 could be driven by a motor assembly not shown in a well-known conventional manner by any suitable well-known drive arrangement not shown.

Each of the housings 12 and 14 have a respective window 31 and 32 in which the rolls 24, 26, 28 and 30 are supported for rotation about axes 42, 44, 46 and 48, respectively. The rolls 24, 26, 28 and 30 are preferably vertically aligned so that they are all in a substantially vertical plane 49 oriented substantially perpendicular to the strip rolling direction. The rolls 24, 26, 28 and 30 are also preferably laterally aligned so that each of the axes of rotation 42, 44, 46 and 48 is substantially perpendicular to the strip rolling direction. While a particular roll alignment has been described above, the rolls 24, 26, 28 and 30 could have any desired vertical or lateral alignment.

Upper and lower back-up rolls 28 and 30 have ends which are respectively supported for rotational movement in support assemblies 38 and 40. Work rolls 24 and 26 have ends which are respectively supported for rotational movement in support assemblies 34 and 36. The support assemblies 34, 36, 38 and 40 may comprise any well-known conventional support arrangement. In a preferred embodiment, the support assemblies 34 and 36 are nested within substantially U-shaped notches 39 and 41 in support assemblies 38 and 40, respectively. Within the U-shaped notches 39 and 41 are protective covers 70 and 71, respectively. Protective covers 70 and 71 are also preferably U-shaped. Support assemblies 34 and 36 are preferably arranged for vertical movement relative to the sidewalls of the covers.

Each of the housings 12 and 14 has a presser assembly 50 associated therewith. The presser assembly 50 provides a desired compressive force between the back-up rolls 28 and 30 and the work rolls 24 and 26 to obtain a desired strip gage reduction. Presser assembly 50 may be either a hydraulic actuator not shown or a screw actuator 52 driven by a motor drive 54 in any suitable manner.

Support assemblies 38 and 40 are horizontally positioned within each of the windows 31 and 32 by slide plates 56 and 58, respectively. The slide plates are preferably adjustably mounted to housings 12 and 14 by bolt and nut assemblies 60 or by any other suitable fastening devices. The slide plates 56 and 58 each preferably have a plurality of slots 59 which permit adjustment of the slide plate position. When rolling mill apparatus 10 is to be used as a non-reversing mill, slide plates 56 and 58 are positioned on the strip exit side of the housings for reasons noted hereinafter. In lieu of adjustable plates 56 and 58, fixed positioned plates not shown may be utilized if so desired.

Since support assemblies 34 and 36 preferably nest within support assemblies 38 and 40, plates 56 and 58 will also position support assemblies 34 and 36. However, in a preferred embodiment, slide plates 61 and 63 are adjustably mounted to support assemblies 34 and 36 in any suitable manner to permit position adjustment of the support assemblies within covers 70 and 71. Slide plates 61 and 63 are preferably placed on the same side of the rolling mill apparatus 10 as slide plates 56 and 58. Therefore, in a non-reversing mill, slide plates 61 and 63 are preferably positioned on the strip exit side of the support assemblies.

Figure 5:
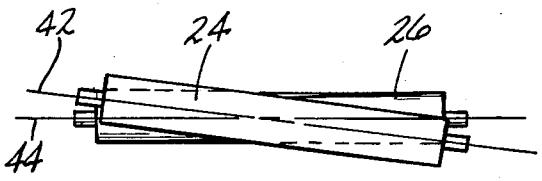
FIG. 5 is a schematic representation of a roll cross-over condition.
Figure 3:
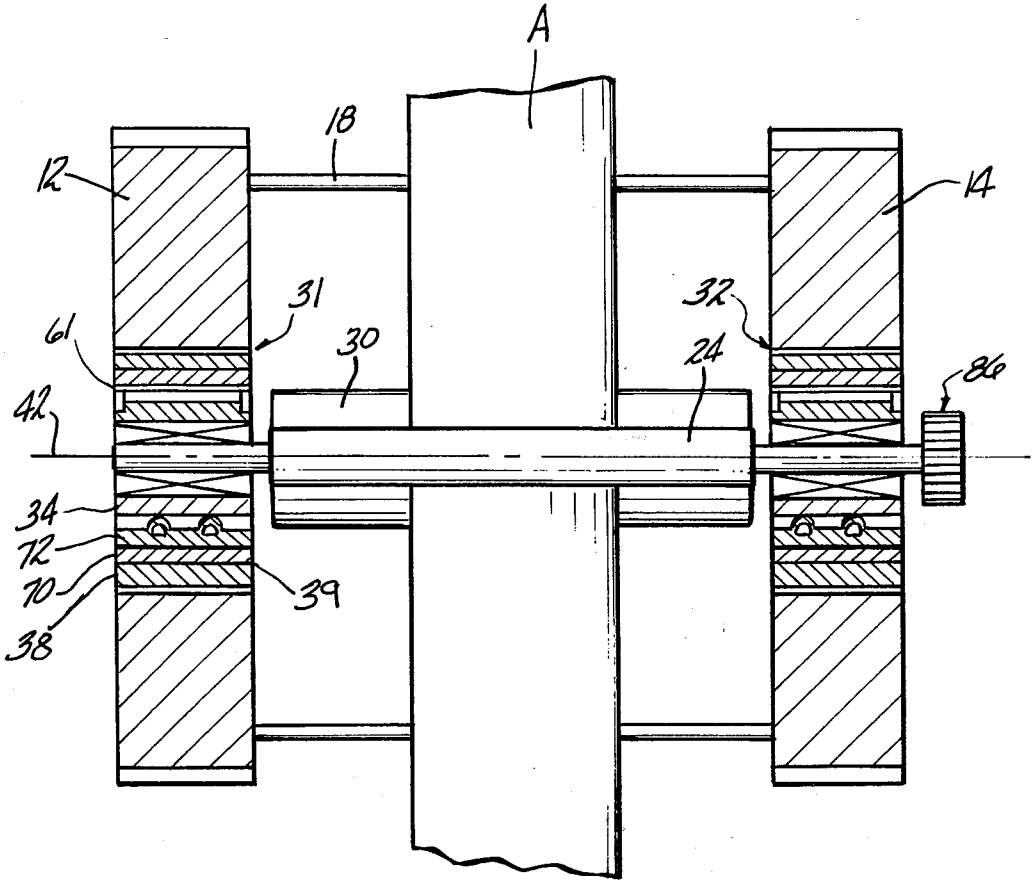
FIG. 3 is a sectional view along line III—III of FIG. 1.

Forces, such as frictional forces, vibrational forces, etc., that develop during the rolling process frequently cause one or more of the support assemblies 34, 36, 38 and 40 to move in a direction parallel to the rolling direction. This is known as roll shifting or slipping. The forces may also cause one or more of the rolls to tend to move so that one or more of the axes 42, 44, 46 and 48 is angled relative to the remainder of the axes. In other words, one support assembly in one housing tends to slip more than the support assembly in the other housing and more than the support assemblies of one or more of the other rolls. This condition is known as roll cross-over. FIG. 5 shows such a roll cross-over condition for work rolls 24 and 26 where the axes 42 and 44 are angled relative to each other. As the rolls and their support assemblies tend to shift or slip, gaps or clearances may be created between one or more of the support assemblies and their respective support structures. Furthermore, gaps or clearances may be created by wear or movement of slide plates 56, 58, 61 and 63.

To substantially eliminate any clearances that may occur, a first set of inflatable pads 64 are preferably positioned between each of the support assemblies 38 and and 40 and the sidewalls of windows 31 and 32 opposite slide plates 56 and 58. In a non-reversing mill, inflatable pads 64 are preferably placed on the strip entry side of the windows 31 and 32 so that the forces pulling strip A through the mill do not act against the pads 64. The inflatable pads 64 substantially occupy any clearance space between the window sidewalls and the support assemblies 38 and 40. When in a deflated or partially inflated condition, inflatable pads 64 permit vertical and horizontal adjustment of support assemblies 38 and 40 within windows 31 and 32. Support assemblies 38 and 40 may be vertically adjustable in any well-known manner.

A second set of inflatable pads 72 are preferably positioned between each of the support assemblies 34 and 36 and the sidewalls of the covers 70 and 71 opposite the slide plates 61 and 63. In a non-reversing mill, these pads are also preferably placed on the strip entry side of support assemblies 34 and 36 so that the forces pulling strip A through the mill do not act against pads 72. Inflated pads 72 substantially occupy any clearance space between the cover sidewalls and support assemblies 34 and 36. When in a deflated or partially inflated condition, inflatable pads 72 permit vertical and horizontal adjustment of support assemblies 34 and 36. Support assemblies 34 and 36 may be vertically adjustable in any well-known manner.

Inflatable pads 64 and 72 may have any suitable shape and may be formed in any suitable manner. In a preferred embodiment, pads 64 and 72 comprise composite metal or metal alloy panels or plates having fluid passageways 80. The panels are preferably formed by the ROLL-BOND® process shown in U.S. Pat. No. 2,690,002. The panels or plates may be made from copper, copper alloy, aluminum, aluminum alloy, or any other suitable metal or metal alloy. Alternatively, the panels or plates may be non-metallic. For example, the panels or plates could be constructed of a plastic material. The inflatable pads 64 and 72 may be formed with fluid passageways 80 having any suitable pattern. Furthermore, the passageways 80 may initially be either inflated or uninflated.

Inflatable pads 64 and 72 are connected to a source of pressurized fluid 74 through any suitable conventional valve means 76. The valve means for supplying fluid to passageways 80 in pads 64 and 72 may be either manually operated or automatically operated by any suitable conventional control system 78. The control system 78 may receive position input data from sensors not shown which measure any gap or clearance space that may develop between the window sidewalls and support assemblies 38 and 40 and/or the cover sidewalls and support assemblies 34 and 36 as a result of the forces, such as vibrational and frictional forces, which act on work rolls 24 and 26 and back-up rolls 28 and 30 and their respective support assemblies 34, 36, 38 and 40. Any clearance may be reduced to substantially zero by operating control system 78, either automatically or manually, to supply fluid to one or more of inflatable pads 64 and 72 through valve means 76. The fluid may be supplied to pads 64 and/or 72 and the adjustments made either during rolling or while the apparatus 10 is not in operation. The pads 64 and 72 may be provided with fluid to make fine adjustments to the alignment of the rolls and roll support assemblies. The pressurized fluid may be either hydraulic or pneumatic.

Periodically, one or more of rolls 24, 26, 28 and 30 may either have to be replaced due to normal roll wear or have to be repositioned in a vertical sense. The fluid supply system is provided with a suitable fluid withdrawal mechanism such as pump means 79 to remove fluid from the pads 64 and 72. Pump means 79 and valve means 76 are preferably arranged so that fluid may be removed from either one pad, all pads, or any combination of pads. Any suitable well-known device may be used for pump means 79. The fluid may be withdrawn from the pads 64 and 72 and either returned to fluid source 74 or expelled from the system. After fluid is removed from one or more of the pads 64 and 72, sufficient clearance should be present to replace or reposition one or more of the rolls and/or its supporting assembly or assemblies.

Rolling mill apparatus 10 has mechanisms 84 and 88 for decoiling and recoiling strip A and for applying tension to strip A. When apparatus 10 is used as a non-reversing mill, mechanism 84 preferably comprises a decoiler and mechanism 88 preferably comprises a recoiler. When apparatus 10 is used as a reversing mill, both mechanisms 84 and 88 preferably comprise a decoiler/recoiler. Any suitable conventional devices may be used for the decoiler and/or recoiler assemblies 84 and 88.

In operation, strip A is caused to pass between upper and lower work rolls 24 and 26. The strip is maintained under tension by decoiler and/or recoiler assemblies 84 and 88. A compressive force is applied to upper and lower back-up rolls 28 and 30 and upper and lower work rolls 24 and 26 by presser assemblies 50. During rolling, clearances may develop between support assemblies 34, 36, 38 and 40 and their respective support structures such as the sidewalls of windows 31 and 32 and the sidewalls of covers 70 and 71. These clearances may be visually observed by the roll mill operator who then actuates control system 78 to supply fluid to inflate one or more of the pads 64 and 72 to obviate these clearances. Alternatively, the clearances may be sensed by sensors and control system 78 automatically operated to supply fluid to inflate one or more of the pads 64 and 72 to obviate the clearances. By inflating one or more of pads 64 and 72, the clearances are reduced to substantially zero, thereby substantially holding the rolls and their support assemblies in the desired alignment and substantially preventing roll shifting and/or cross-over.

By placing pads 64 and 72 on one side of the rolling mill apparatus 10, the rolls are locked to one side of apparatus 10 and the tolerances can only act and accumulate from the opposite side. In a non-reversing mill, pads 64 and 72 are preferably placed on the strip entry side of the support assemblies. In this way, since the strip tension at the exit side is greater than the strip tension at the entry side, the forces tending to pull the strip through the rolling mill do not act against the pads 64 and 72.

While the instant invention has been described as part of a four-high rolling mill, it is readily adaptable to other types of reversing and non-reversing rolling mills such as two-high, three-high, six-high, etc., rolling mills.

While the instant invention has been described as part of a system that maintains the rolls and their support assemblies in substantially vertical and substantially lateral alignment, the instant invention is readily adaptable to systems having other types of roll and roll support assembly alignments.

While the inflatable pads have been described as being formed by the ROLL-BOND® process described in U.S. Pat. No. 2,690,002, any suitable inflatable pad formed by any process can be utilized.

The patents set forth in this specification are intended to be incorporated by reference herein.

It is apparent that there has been provided in accordance with this invention a zero clearance device for a rolling mill apparatus which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A rolling mill apparatus for reducing the thickness of a continuous strip material, said apparatus comprising:

a pair of laterally spaced housings;

each said housing having a window with sidewalls;

at least two rolls between which said strip passes;

means for supporting each of said rolls within said windows;

inflatable means for substantially maintaining said rolls in vertical and lateral alignment and for substantially preventing shifting and cross-over of said rolls, said inflatable means comprising a plurality of metal or metal alloy panels having inflatable fluid passageways; and each said panel being disposed between one of said supporting means and a respective one of said window sidewalls so that clearances between said support means and said sidewalls are substantially eliminated.

2. The apparatus of claim 1 further comprising:

a source of fluid under pressure; and said passageways being connected to said fluid source.

3. The apparatus of claim 1 further comprising:

said mill being a non-reversing mill having a strip entry side and a strip exit side; and said panels being disposed on the strip entry side of said supporting means.

4. The apparatus of claim 1 further comprising:

at least two work rolls between which said strip passes;

at least two back-up rolls in frictional engagement with said work rolls;

said supporting means comprising means for supporting each said work roll and means for supporting each said back-up roll; and each of said supporting means having one of said panels associated therewith.

5. The apparatus of claim 1 further comprising:

means for sensing any clearance between said roll support means and said sidewalls; and means for automatically adjusting at least one of said panels in response to said sensed clearance to substantially eliminate said clearance.

6. A process for reducing the thickness of a continuous strip material, said process comprising:

providing a rolling mill having a pair of laterally spaced housings and at least two rolls, each said housing having a window with sidewalls and each said roll having roll support means associated therewith;

mounting said roll support means within said windows;

placing an inflatable metal or metal alloy panel having at least one fluid passageway between each said roll support means and a respective one of said sidewalls to vertically and laterally align said rolls and to substantially prevent shifting and cross-over of said rolls;

passing said strip material between said at least two rolls to effect said thickness reduction; and inflating said panels to substantially eliminate any clearances between said roll support means and said sidewalls, to substantially prevent shifting and cross-over of said rolls as a result of said strip passing between said rolls, and to maintain said roll alignment.

7. The process of claim 6 further comprising:

providing a source of fluid under pressure; and connecting said passageways to said fluid source.

8. The process of claim 6 wherein said mill comprises a non-reversing mill having a strip entry side and a strip exit side, said process further comprising:

said step of placing said panels comprises placing said panels on said strip entry side of said roll support means.

9. The process of claim 6 further comprising:

sensing any clearance between said roll support means and said sidewalls; and automatically adjusting at least one of said panels in response to said sensed clearance to substantially eliminate said clearance.

* * * * *